United States Patent [19]

Elsener

[11] Patent Number: 4,815,180

[45] Date of Patent: Mar. 28, 1989

[54] TRANSFERRABLE JEWELRY CLASP WITH NECK CHAIN OR NECK BAND

[76] Inventor: Carl Elsener, Uetlibergstrasse 60, CH-8902 Urdorf, Switzerland

[21] Appl. No.: 131,028

[22] Filed: Dec. 10, 1987

[30] Foreign Application Priority Data

Dec. 17, 1986 [CH] Switzerland ..... 05 014/86

[51] Int. Cl.[4] ..... A44C 9/00

[52] U.S. Cl. ..... 24/616; 63/15.7

[58] Field of Search ..... 24/241 R, 241 P, 242, 24/616, 618, 116 A; 63/1 R, 12, 15.7, 15.65

[56] References Cited

U.S. PATENT DOCUMENTS

| | | | |
|---|---|---|---|
| 87,072 | 2/1869 | Rowland . | |
| 206,777 | 8/1878 | Dolloff | 24/616 |
| 208,968 | 10/1878 | Dolloff . | |
| 241,462 | 5/1881 | Washburn . | |
| 248,641 | 10/1881 | Etzensperger | 24/616 |
| 393,222 | 11/1888 | Elleau | 24/616 |
| 411,509 | 9/1889 | Pike . | |
| 482,885 | 9/1892 | Wallace | 24/241 P |
| 594,532 | 11/1897 | Hatten . | |
| 1,003,696 | 9/1911 | Briggs | 63/15.7 |
| 1,193,330 | 8/1916 | Wray | 24/616 |
| 3,524,230 | 8/1970 | Hankel . | |
| 3,736,770 | 6/1973 | Kelrick . | |
| 4,292,715 | 10/1981 | Huddon . | |
| 4,694,664 | 9/1987 | Elsener . | |

FOREIGN PATENT DOCUMENTS

| | | | |
|---|---|---|---|
| 32958 | 12/1907 | Austria . | |
| 62673 | 8/1913 | Austria . | |
| 76100 | 12/1893 | Fed. Rep. of Germany | 24/241 P |
| 3028470 | 3/1982 | Fed. Rep. of Germany . | |
| 3434475 | 11/1985 | Fed. Rep. of Germany . | |

*Primary Examiner*—Victor N. Sakran

*Attorney, Agent, or Firm*—Thomas W. Speckman

[57] ABSTRACT

A transferable jewelry clasp that can be worn with different chains or bands which has the shape of a ring or has a central opening and has an upper part and a lower part. These parts are connected with one another on one side by means of a hinge, and on the opposite side by means of a snap clasp. It can thus be opened and closed easily. In order to ensure that the jewelry clasp is not lost, two cams directed inwardly toward the central opening are attached to the upper part. Eyelets are attached to the ends of the chain, which are so dimensioned that their internal diameters are larger than the thickness of the jewelry clasp ring and smaller than the thickness of the ring plus the height of the cam. With such dimensioning, the chain and eyelets can only be attached to a position differing from the supporting direction on the upper clasp part, and the danger of loss is avoided, even if the jewelry clasp is opened involuntarily.

4 Claims, 4 Drawing Sheets

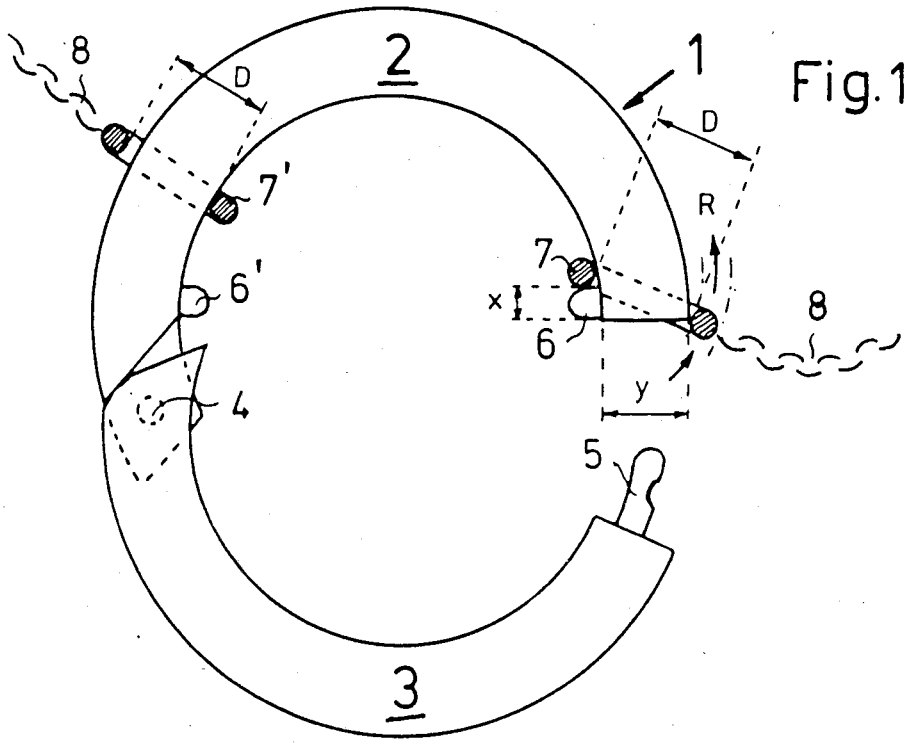
Fig.1
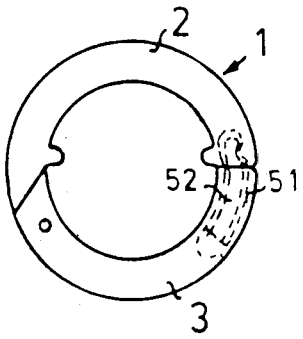
Fig.2
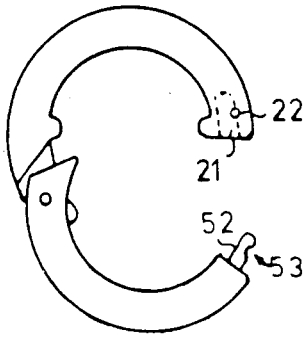
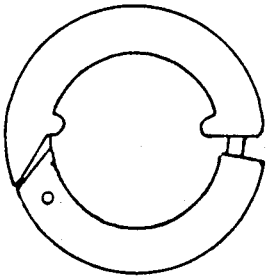
Fig. 3
Fig.4

TRANSFERRABLE JEWELRY CLASP WITH NECK CHAIN OR NECK BAND

BACKGROUND OF THE INVENTION

This invention relates to a transferable jewelry clasp for different neck chains or bands, the end eyelets of which are dimensioned corresponding to the jewelry piece, while the jewelry clasp is formed in a ring shape or has a central opening and is divided into an upper and a lower part, which, on one side, are connected with one another by means of a hinge and, on the opposing side, are connected with one another by means of a snap clasp. The invention also relates to a process for producing the snap clasp of the jewelry clasp in accordance with the invention.

Jewelry pieces which are carried on a neck chain are generally provided with a clasp for connecting the ends of the chains, if the chain is relatively short. This clasp, however, frequently slips forward, and this causes an unattractive effect. An attractive chain would also be able to be used more frequently if it could be connected with the jewelry piece in another way.

This is possible if the jewelry piece itself functions as a jewelry clasp. In this manner, a separate chain clasp can be eliminated, and the jewelry piece thus formed can be held on the ends of the chains by means of eyelets. The jewelry piece itself then serves as a clasp for the chain or the neck band. The jewelry piece formed in this manner can then be carried by different chains or bands.

In order to ensure that such a jewelry piece formed as a clasp does not open unintentionally and is lost, a good safety must be provided. In order, however, to be as secure as possible, such a secured clasp can only be opened by intricate means. The present invention creates a new and elegant solution for this problem. It starts with an easy-to-open jewelry clasp provided with a snap clasp which can be carried with different chains and neck bands.

This invention solves the problem by means of a transferable jewelry clasp for different neck chains or bands, the end eyelets of which must be dimensioned corresponding to the jewelry piece. The jewelry clasp is formed in a closed shape, such as ring shape, having a central opening, and is divided into an upper part and a lower part, whereby these parts are connected with each other on one side by means of a hinge, and on the opposing side by means of a snap clasp. The upper part, both on the side of the snap clasp as well as on the side of the hinge, has a cam directed inwardly to the central opening. The end eyelets of the neck chain or band are so dimensioned, that their internal diameter is greater than the thickness of the upper part and smaller than the thickness of the upper part plus the height of the cam, so that the eyelets can only be attached or detached in the open position of the clasp by means of the cam and the upper part. The snap clasp of the jewelry clasp in accordance with the invention can be produced in accordance with the process comprising the steps: making borings in a generally tangential direction in each the upper and lower part, respectively, in the end of said opposing snap clasp side; inserting a spring pin having a thickened lower end within the lower boring; drilling, inserting and soldering a pin into the thickened lower end; closing the clasp, whereby the free end of the spring pin projects into the opposing upper boring; making a boring laterally to the axis of the spring pin at a point where the bore projects out from the spring pin at the same time as forming a rounded groove in the spring pin; and inserting and soldering a locking pin into the lateral boring.

BRIEF DESCRIPTION OF THE DRAWING

A number of specific embodiments of this invention are shown in the drawing wherein:

FIG. 1 shows a ring-shaped jewelry clasp in simplified representation and enlarged scale with attached chain;

FIGS. 2–4 show the jewelry clasp of FIG. 1 in different opening;

DESCRIPTION OF PREFERRED EMBODIMENTS

Figure 5:
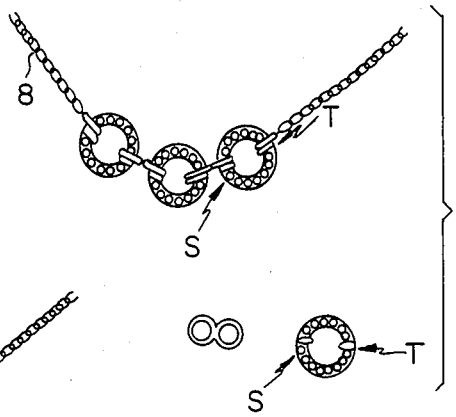
FIGS. 5–9 show different embodiments of jewelry clasps with attached chain.

The jewelry clasp (1), shown in simplified form and larger scale in FIG. 1, is constructed in a ring form, and comprises an upper part (2) and a lower part (3), which are connected with one another in a pivotal manner by means of a hinge pin (4) A snap clasp (5) is attached to the side lying diametrically opposed to the hinge, which clasp is illustrated in greater detail by means of FIG. 2. The designations upper and lower part refer to position which the jewelry clasp occupies when being worn, if it is attached to the chain or the band. The upper part (2) is provided with two cams (6, 6') projecting inwardly, with one attached adjacent the separating point between the upper and the lower part, and the second one (6') attached to the hinge side. In FIG. 1, it is evident that end eyelet (7) of chain (8) can be attached to upper part (2). The eyelet must therefore be brought above the cam (6) and can then be rotated in the direction of the arrow (R). The position of the eyelet may vary greatly when being worn, but, with correct dimensioning, the sole possible position for applying the eyelet to the upper part is as described above. Strictly speaking, the internal diameter (D) of the end eyelet must be dimensioned so that $D=\sqrt{x^2+y^2}$, wherein x=the width of the cam and y=the width of the jewelry clasp in the radial direction. The width x of the cam should not be too great, since otherwise the internal diameter (D) would have to be made so large that this would nullify the security against unintentional unhinging. The correct dimensioning of the eyelets ensures that, even in the event that the jewelry clasp opens unintentionally when being worn, it can not be released from the chain. The upper part (2) of the jewelry clasp is provided with a second cam (6'), and this ensures that the eyelets (7 and 7') always remain in the area of the upper half. In this way, any danger of the loss of the jewelry clasp while being worn is avoided. In addition, it should be noted that the chain itself no longer requires a clasp.

FIGS. 2 to 4 show the same ring-shaped jewelry clasp in a smaller scale. In these figures, one embodiment of the snap is depicted. A springy pin (52) is attached to the base of an enlarged boring (51) of the lower part (3) and has a groove (53). The free end of the pin, in the closed condition, engages with the groove and snaps behind a blocking projection in a wide boring (21) of the upper part (2). Such a projection can be produced for example by means of a small bolt (22) inserted into a lateral boring, as is depicted in FIG. 4.

FIGS. 5 to 9 show a number of possible forms of execution of jewelry clasps with attached chain, approximately in natural size. In FIG. 5, three ring-shaped jewelry clasps which can be opened are connected by means of double rings. This allows the wearer to attach a single or several of such jewelry clasps to the same chain. At the lower part of FIG. 5, such a double ring and a single jewel clasp is depicted. The arrows (S and T) indicate the joint of the hinge (S) and the separation point (T) of both parts. The direction of the arrows align with the direction of the joints, which can barely be discerned in the closed condition. Both cams (6, 6') can be clearly seen, but are not provided with reference numbers, in order to not overburden the figure.

Figure 6:
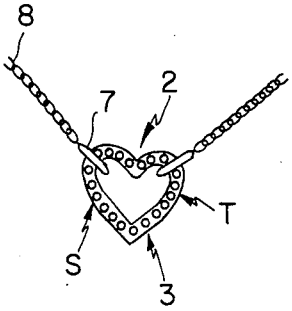
Figure 8:
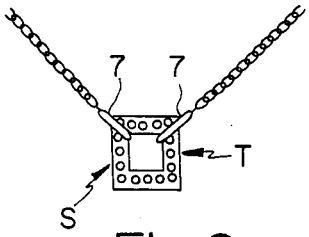
Figure 7:
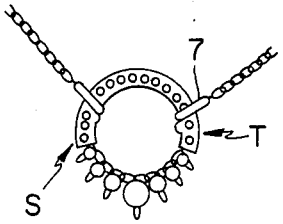
Figure 9:
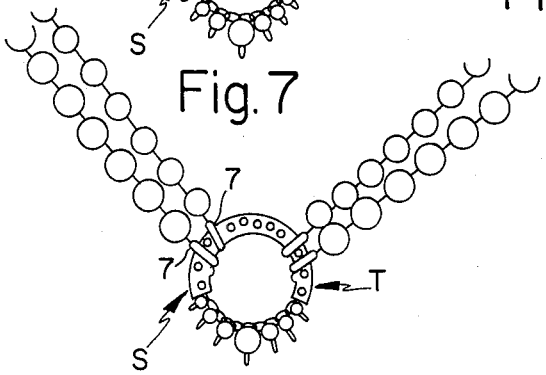

FIG. 6 depicts a heart-shaped jewelry clasp with a chain, according to the invention. Here, too, the hinge (S) and the separating point (T) are indicated by arrows for direction and position. FIGS. 7, 8 and 9 depict further embodiments. FIG. 7 depicts a jewelry clasp, which closes the sole chain, while FIG. 9 shows the same jewelry clasp as a clasp for a double-rowed pearl necklace.

Figure 10:
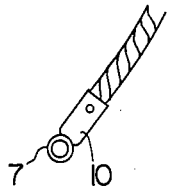
FIG. 10 shows an end of a band with an eyelet.
Figure 11A:
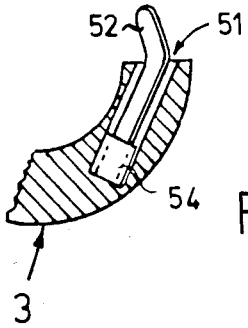
FIGS. 11*a*–11*c* show an embodiment of a covered snap clasp.
Figure 11B:
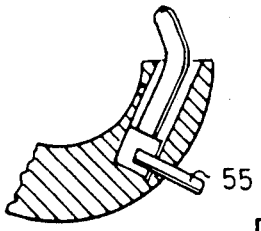
Figure 11C:
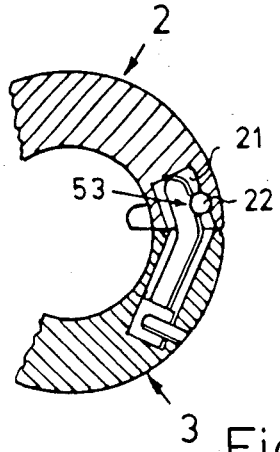

The pearl necklace is divided into two separate chains which are each provided with end eyelets. This makes it possible for the wearer to carry the jewelry clasp with a simple or with a double chain. FIG. 10 shows, finally, a modern band, the end (10) of which is provided with an eyelet (7). The eyelet is dimensioned corresponding to the jewelry clasp to be connected with it, so that the eyelet can only be attached in a position differing from the direction of support on the upper part of the jewelry clasp. The production of a covered snap clasp in accordance with FIGS. 2 to 4 is further illustrated by means of FIGS. 11*a* to 11*c*. In this, the borings (51 and 21) are made in the parts (2 and 3) of the jewelry piece. In a ring-shaped jewelry clasp, these run approximately tangentially. The boring (51), which is to accommodate the spring pin, is deeper than the boring (21) with the locking bolt (22). A spring pin (52) with thickened lower end (54) is inserted into the deeper boring (51), and is pinned and soldered in the correct position with the pin (55) as shown in FIG. 11*b*.

Now the jewelry clasp is closed, so that the free end of the spring pin (52) projects into the boring (21). Now, a boring running laterally to the axis of the spring pin can be made at a point which is so selected that the borer excavates at the same time a rounded groove (53) from the spring pin. In this manner, a locking projection, and the locking groove corresponding to the same, are formed at the same time as the application of the bolt (22).

Figure 13:
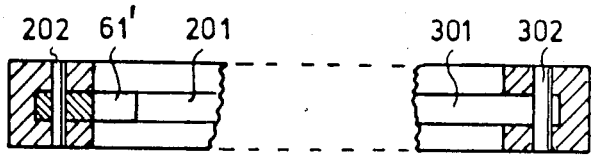
FIG. 13 shows a section along the line XIII—XIII in FIG. 12.
Figure 14:
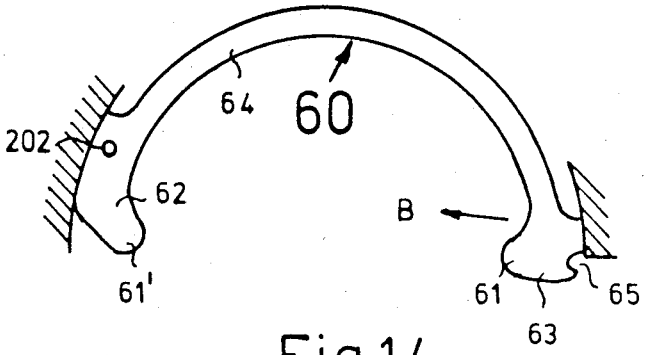
FIG. 14 shows enlarged detail of the jewelry clasp in accordance with FIG. 12.

Such types of boring and soldering work are undesirable in standard or factory production. The variants of a simple jewelry clasp depicted in FIGS. 12 to 14 avoid hard-to-execute boring operations and entirely dispense with soldering.

Figure 12:
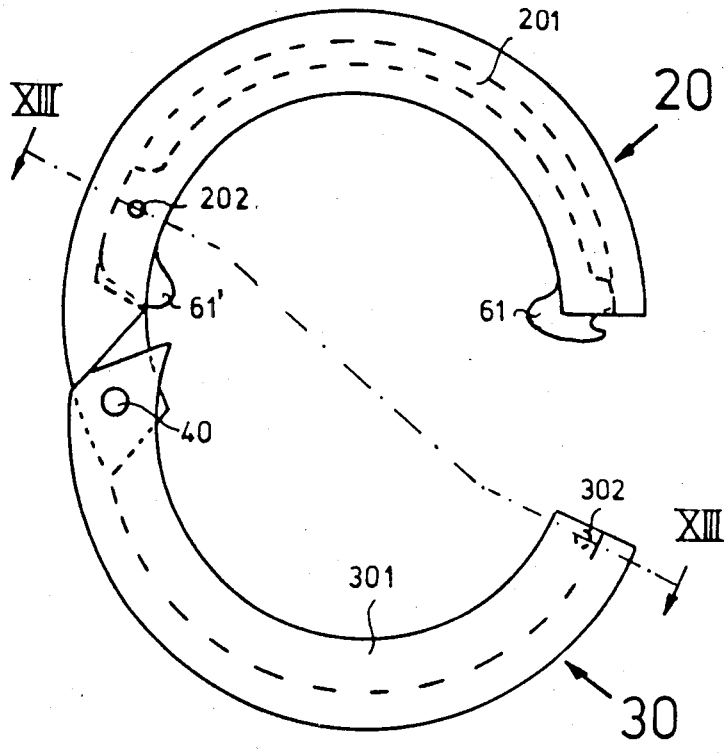
FIG. 12 shows another embodiment of a ring-shaped jewel clasp.

The general construction corresponds to that shown in FIG. 1. The jewelry clasp again comprises an upper half (20) and a lower half (30), which are connected with one another in a hinged manner by means of pin (40). The simplification consists of the fact that the spring part (60) of the clasp is provided with cams (61, 61'). The spring part (60) lies in a groove (201) of the upper part (20) and, in its assembled condition, only both the cams (61, 61') project out from the groove. The spring part (60) is flat, so that it is guided in the groove. Both the ends (62 and 63) are expanded, while the narrower part (64) lying between them forms the actual spring. The expanded part (62) is so formed that, in the assembled condition, it lies on the base of the groove (201). It is held in this position by means of a pin (202), as is shown in FIG. 12. In the mounted condition, the expanded end (63) lies, if necessary, with lower tension, on the base of the groove (201). This end is not only provided with a cam (61), but also with a slightly rounded hook (65). In the open condition of the jewelry clasp, this hook projects beyond the end of upper half (20).

The lower half (30) of the jewelry clasp is likewise provided with a groove (301), which, next to the separating point, has a boring, into which a pin (302) is inserted. If both the halves (20, 30) are closed, then the spring part bends a little in the direction of the arrow (B) (FIG. 14), the hook thereby snaps behind the pin (302), and the jewelry clasp remains closed. The effect of both cams (61, 61') is the same as previously described with respect to FIG. 1. Even if the jewelry clasp is unintentionally opened during wearing, it still remains, thanks to the cams (61, 61'), hanging to the eyelets of the chain. It is naturally a presupposition for this that these eyelets, as likewise previously described, have the correct size.

As is evident from the drawing and as shown in the drawing, borings must be applied and pins inserted during mounting here as well. These are, however, much simpler to attach than the borings in the execution in accordance with FIG. 1. Furthermore, no soldering is required.

I claim:

1. A transferable jewelry clasp for different neck chains or bands, the end eyelets of which are dimensioned corresponding to the jewelry clasp, while the jewelry clasp is formed in a closed shape having a central opening, and is divided into an upper part (2) and a lower part (1), whereby these parts are connected with each other on one side by means of a hinge, and on the opposing side by means of a snap clasp, comprising on said upper part (2), both on the side of said snap clasp as well as on the side of said hinge, a cam (6, 6') directed inwardly to said central opening is attached, and that said end eyelets (7) of said neck chain or band are so dimensioned, that their internal diameter (D) is greater than the thickness of said upper part (2) and smaller than the thickness of said upper part (2) plus the height of said cam, so that it can only be attached or detached in the open position of the clasp by means of said cam and said upper part (2).

2. A jewelry clasp in accordance with claim 1, wherein both said cams (6, 6') are firmly connected with said upper part (2).

3. A jewelry clasp in accordance with claim 1, wherein both said cams (6;, 61') are end parts of a spring (60) positioned in the upper half of said jewelry piece, which spring comprises one part of said snap clasp.

4. A jewelry clasp in accordance with claim 3, wherein said spring (60) lies in a groove (201) in said upper half of said jewelry piece (20), from which groove at least both said cams (61, 61') project.

* * * * *